US007258573B1

(12) United States Patent
Lee

(10) Patent No.: US 7,258,573 B1
(45) Date of Patent: Aug. 21, 2007

(54) MULTIPLE VERTICALLY STACKED CONNECTOR STRUCTURE

(75) Inventor: Yung-Sen Lee, Taipei (TW)

(73) Assignee: Inventec Corporation (TW)

( * ) Notice: Subject to any disclaimer, the term of this patent is extended or adjusted under 35 U.S.C. 154(b) by 0 days.

(21) Appl. No.: 11/395,999

(22) Filed: Mar. 30, 2006

(51) Int. Cl.
*H01R 13/60* (2006.01)

(52) U.S. Cl. ..... 439/541.5

(58) Field of Classification Search ..... 439/541.5, 439/620.06, 620.12, 620.15
See application file for complete search history.

(56) References Cited

U.S. PATENT DOCUMENTS 4,867,680 A * 9/1989 Hare et al. ..... 433/37
6,109,934 A * 8/2000 Madsen et al. ..... 439/79
6,315,618 B1 * 11/2001 Francis ..... 439/676
6,896,542 B2 * 5/2005 Chang ..... 439/490
2004/0203280 A1 * 10/2004 Chang ..... 439/541.5
2006/0134975 A1 * 6/2006 Osada ..... 439/541.5

* cited by examiner

*Primary Examiner*—James R. Harvey
(74) *Attorney, Agent, or Firm*—Peter F. Corless; Steven M. Jensen; Edwards Angell Palmer & Dodge LLP

(57) ABSTRACT

A multiple vertically stacked connector is capable of minimizing the occupied area of connectors stacked on a printed circuit board, and also effectively reducing electromagnet interference generated by stacked connectors. The multiple stacked connector structure includes: a printed circuit board adapted to provide a plurality of connectors vertically stackable thereon, the connecting ground pin of each of the plurality of connectors being respectively connected to the printed circuit board, wherein a groove formed on the printed circuit board spaces apart the regions where the connectors are connected on the printed circuit board.

1 Claim, 2 Drawing Sheets

MULTIPLE VERTICALLY STACKED CONNECTOR STRUCTURE

FIELD OF THE INVENTION

The present invention relates broadly to a multiple stacked connector, and more particularly, to a multiple vertically stacked connector structure capable of effectively reducing the problem of signal transmission interference between multiple stacked connectors.

BACKGROUND OF THE INVENTION

Portable electronic devices, such as cell phones and compact computers, need an efficient circuit configuration that occupies a small volume. Conventional connectors consume excessive package volume and printed circuit board area. As functionality increases, the demand for volume reduction becomes increasingly important, especially for slim-profile casings. The limitations of space and height for configuring connectors on a printed circuit board necessitates that the connectors be utilized in a vertically-stacked fashion, such that the connector-occupied area can be minimized, conserving valuable real estate on the surface of the circuit board for other components and circuitry.

Although a stacked configuration can save valuable configuration space on a circuit board to allow for optimal use, multiple connectors stacked together commonly influence and interfere with electrical properties of one another. For instance, a video connector transmits analog signals and a serial connector transmits digital signals are often stacked together. In prior techniques where a conventional vertically-stacked connector is employed to connect both a video connector transmitting analog signals and a serial connector transmitting digital signals, transmission interference of the analog and digital signals is likely to occur, thereby adversely affecting signal quality and the reliability of transmission.

Therefore, a need exists for a novel stacked connector structure that not only minimizes the total occupied volume and occupied area of a printed circuit board (PCB) but also can effectively reduce electromagnetic interference caused by the stacked configuration of connectors.

SUMMARY OF THE INVENTION

The present invention aims to eliminate the aforementioned drawbacks, and, as such, a primary objective of the present invention is to provide a multiple vertically stacked connector structure which can reduce the occupied space of the connectors to be stacked on a printed circuit board, and also effectively reduce electromagnetic interference of such a stacked configuration.

In order to achieve the above and other objectives, the present invention provides a multiple vertically stacked connector structure. The multiple vertically stacked connector structure according to one embodiment of the present invention comprises a printed circuit board adapted to provide a plurality of connectors vertically stacked thereon, the connecting ground pin of each of the plurality of connectors being respectively connected to said printed circuit board, wherein a groove configured on said printed circuit board spaces apart the regions where each connector connects thereto on said printed circuit board.

Additionally, in the aforementioned multiple vertically stacked connector structure, the connecting ground pin of each connector is respectively connected to said printed circuit board, such that each connector may or may not share a common grounding point.

In another embodiment of the present invention, a plurality of connectors are vertically stacked on the printed circuit board, and the connecting ground pin of each of the plurality of connectors is respectively connected to said printed circuit board, the stacked connector structure being characterized in that the connecting ground pin of each connector is respectively connected to said printed circuit board, such that each connector does not share a common grounding point. Further, the aforementioned multiple stacked connector structure also includes a groove installed on the printed circuit board that is adapted to space apart the regions each connector connects thereto on the circuit board.

By the provision of the multiple vertically stacked connector structure according to the present invention, the space and area occupied by multiple connectors stacked on a circuit board can be desirably minimized to allow for optimal use, and also the problem of electromagnetic interference can be effectively reduced through the use of independent grounding points for the stacked connectors.

BRIEF DESCRIPTION OF THE DRAWINGS

The multiple vertically stacked connector structure of the present invention can be more fully understood by reading the following detailed description of the preferred embodiments, with reference made to the accompanying drawings, wherein.

DETAILED DESCRIPTION OF THE PREFERRED EMBODIMENTS

The present invention is described in the following with specific embodiments, so that one skilled in the pertinent art can easily understand other advantages and effects of the present invention. The present invention may also be implemented and applied according to other embodiments, and the details may be modified based on different views and applications without departing from the spirit of the invention.

Figure 1:
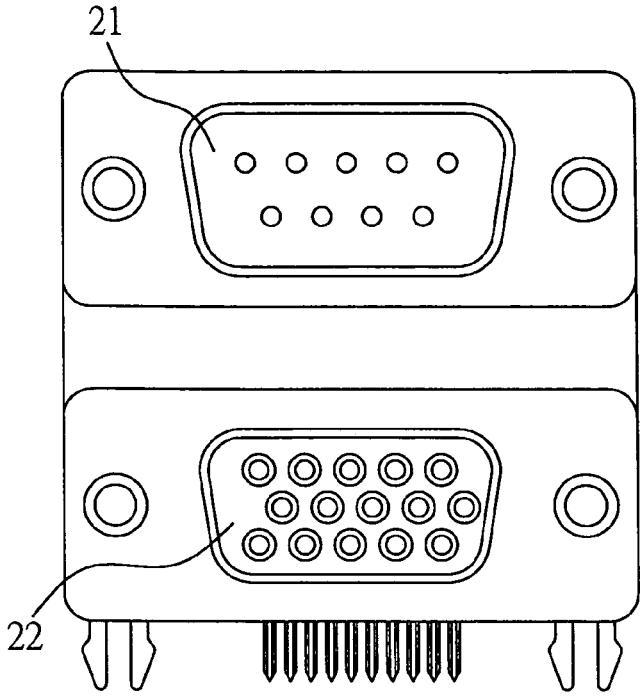
FIG. 1 illustrates a front view showing a plurality of connectors being vertically stacked and connected in the multiple vertically stacked connector structure according to the present invention.

FIG. 1 depicts a front view of multiple connectors being connected in a vertical stack in the multiple vertically stacked connector structure of the present invention. The multiple vertical stacked connector of the invention specifically aims to reduce the connector-occupied area on a circuit board installed in computer casings and also to reduce electromagnetic interference generated by vertically stacked connectors.

In this embodiment, a video connector 22 and a serial connector 21 (such as RS232) are shown as multiple connectors, but it should be understood that the invention is not to be limited to the illustrated embodiment. The multiple vertically stacked connector structure of this embodiment can be applied to any kind of connector for signal transmission.

As shown in FIG. 1, the video connector 22 transmits analog signals whereas the serial connector 21 transmits digital signals, the two connectors being vertically stacked together.

Figure 2:
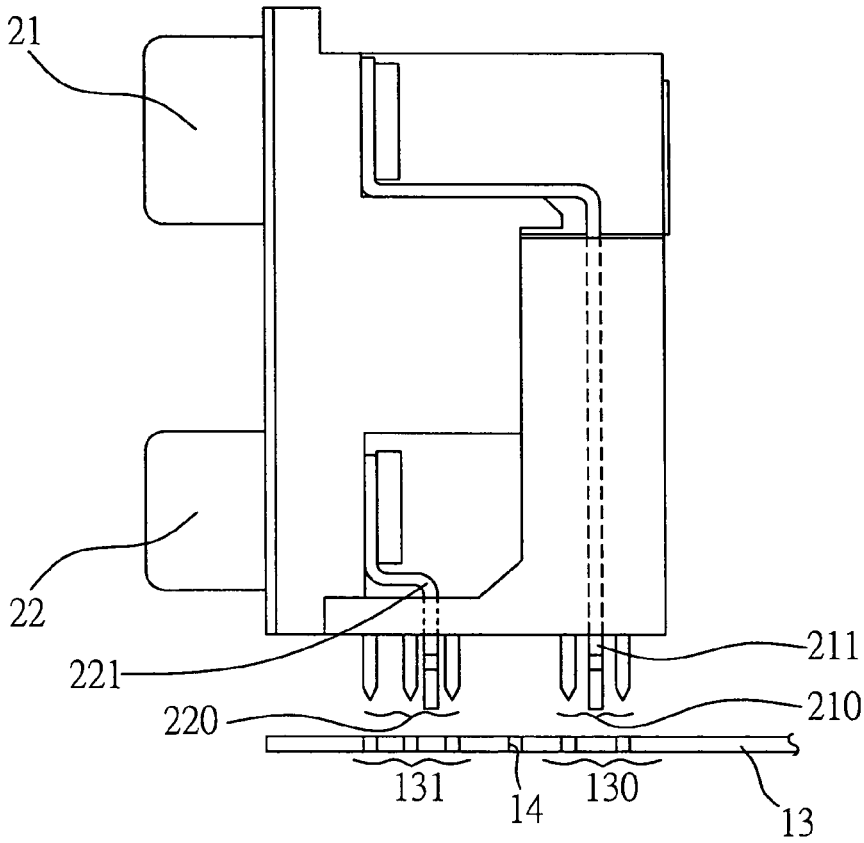
FIG. 2 illustrates a cross-sectional cutting view showing the configuration of a plurality of connectors on a printed circuit board.
Figure 3:
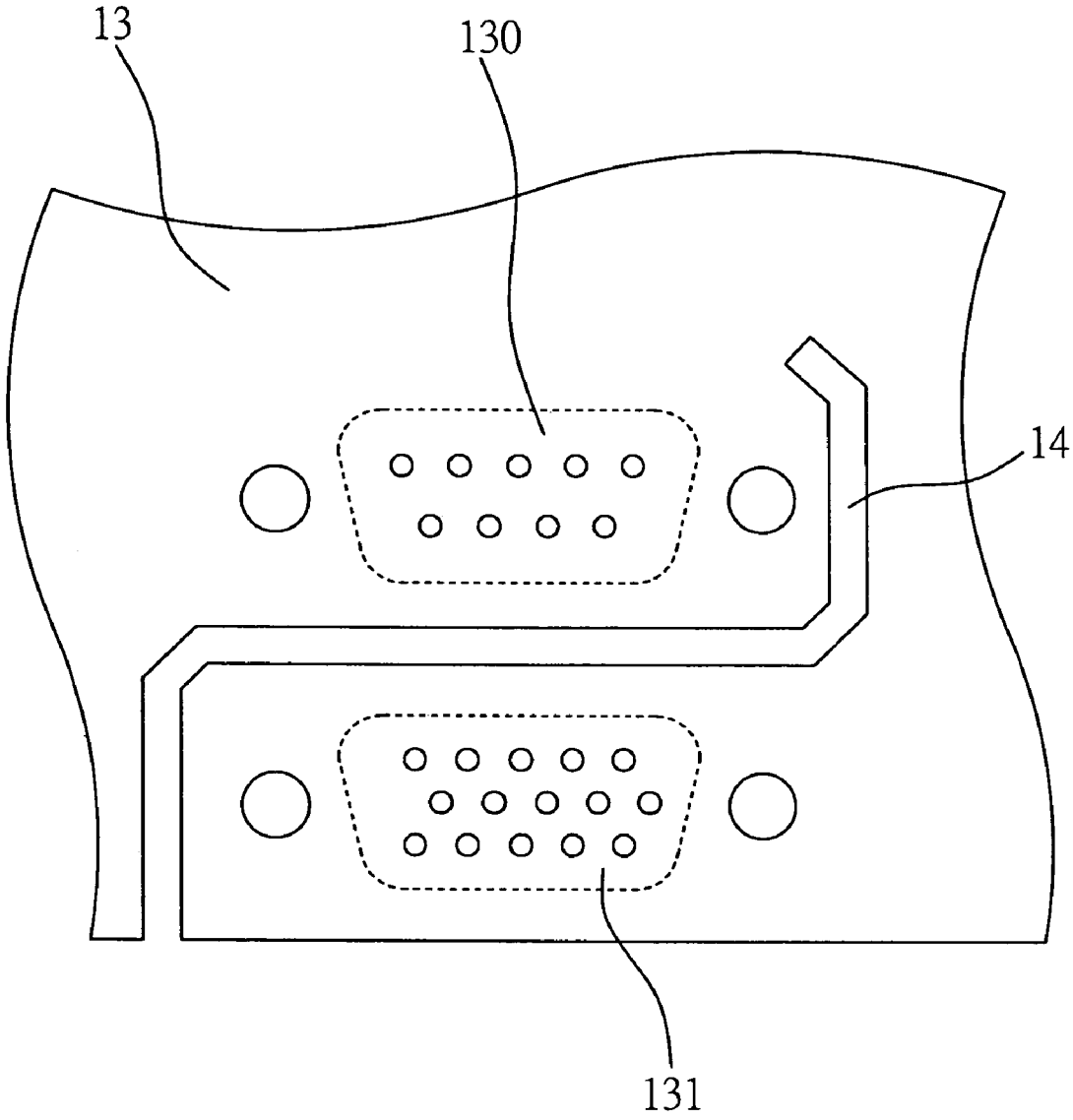
FIG. 3 illustrates a partial top view showing the electrically connected parts between a plurality of connectors and a printed circuit board.

FIG. 2 is a cross-sectional view showing the configuration of a plurality of connectors on a printed circuit board, and FIG. 3 is a partial top view showing the electrically connected parts between a plurality of connectors and a printed circuit board. As shown in FIG. 2 and FIG. 3, the signal connecting feet (210 & 220) of the digital connector 21 and the video connector 22 are each respectively connected to a digital signal region 130 and a video signal region 131 on a printed circuit board 13, wherein the digital signal connecting ground pin 211 of the digital connector 21 and the video signal connecting ground pin 221 of the video connector 22 are each respectively connected to said circuit board 13 such that the two connectors do not share a common grounding point. Such a configuration helps to reduce and prevent electromagnetic interference that is commonly known in the prior art when multiple connectors are vertically stacked together.

In addition, a groove 14 is configured in those areas defined for connecting the video connector 21 and the serial connector 22 on the circuit board 13 so as to space apart the regions of the signal connecting feet (210 & 220) of the digital connector 21 and the video connector 22 connecting with the printed circuit board 13, thereby effectively preventing signal transmission interference between the signal connecting feet (210 & 220) that are closely disposed on the limited space of the circuit board 13.

In conclusion, the multiple vertically stacked connector structure proposed by the invention can effectively reduce the occupied area for connectors that are disposed on the circuit board due to its space-saving configuration and also reduce the potential for electromagnetic interference through the use of spaced apart regions and independent grounding points for the stacked connectors.

It should be apparent to those skilled in the art that the above description is only illustrative of specific embodiments and examples of the present invention. The present invention should therefore cover various modifications and variations made to the herein-described structure and operations of the present invention, provided they fall within the scope of the present invention as defined in the following appended claims.

What is claimed is:

1. A multiple vertically stacked connector structure, comprising:

a printed circuit board;

a video connector installed on the circuit board and having a plurality of first pins, the video connector transmitting analog signals;

a serial connector stacked on the video connector and having a plurality of second pins, the serial connector transmitting digital signals;

a plurality of first connection holes installed within a first region of the circuit board and electrically connected to the first pins of the video connector;

a plurality of second connection holes installed within a second region of the circuit board and electrically connected to the second pins of the serial connector; and a groove formed on the circuit board, wherein a segment from any one of the first connection holes to any one of the second connection holes passes the groove.

* * * * *